United States Patent [19]

Reina Briceño

[11] Patent Number: 4,548,013

[45] Date of Patent: Oct. 22, 1985

[54] CEILING SUSPENSION SYSTEM

[76] Inventor: Enrique Reina Briceño, c/o Arte Ilumi, S.A., Avda. Parima - Qta. Cañaveral, Colinas de Bello Monte, Caracas, Venezuela

[21] Appl. No.: 608,561

[22] Filed: May 9, 1984

[51] Int. Cl.[4] ..... E04C 2/42

[52] U.S. Cl. ..... 52/667; 52/484

[58] Field of Search ..... 52/666, 667, 484, 664, 52/488; 403/346

[56] References Cited

U.S. PATENT DOCUMENTS

| | | |
|---|---|---|
| 2,873,828 | 2/1959 | Zitomer . |
| 2,946,414 | 7/1960 | Gordon et al. . |
| 3,023,861 | 3/1962 | Bak . |
| 3,084,401 | 4/1963 | Findlay . |
| 3,193,063 | 7/1965 | Brown et al. . |
| 4,043,689 | 8/1977 | Spencer et al. . |
| 4,108,563 | 8/1978 | Brown et al. . |
| 4,317,318 | 3/1982 | Sauer . |
| 4,335,973 | 6/1982 | Beck et al. . |
| 4,364,686 | 12/1982 | Sharp et al. . |

OTHER PUBLICATIONS

Roper Eastern Brochure: "Acoustical Ceiling Suspension Systems and Demountable Wall Framing Product List," No. 850841.

*Primary Examiner*—Carl D. Friedman

*Attorney, Agent, or Firm*—Cushman, Darby & Cushman

[57] ABSTRACT

A ceiling suspension grid system is provided in which cross tees are assembled to main beams by pushing tabs in the web of one through a corresponding slot in the web of the other. The slots and webs are vertically oriented. Each slot is provided intermediate its height with at least one wide place of comparatively small vertical extent. The tabs are provided with correspondingly thickened bosses, but at slightly vertically displaced sites, so that two elements which are to be connected are oriented at slightly different levels so that the tab of one may be inserted through the slot of the other. Then, upon these elements being brought to a common level, the tab cannot be withdrawn from the slot. By preference, the tabs of two longitudinally adjoining elements may be inserted in the same slot from opposite directions, and become disposed one over the other with the element ends being notched to accommodate the tabs of one another. Bracing fingers preferably are provided on these element ends to rigidify the assembled gridwork. The slots may be provided with two, vertically spaced wide spots, in order to facilitate disconnection of one of the elements from the crossing element without requiring disconnection of the respective longitudinally continuing element from the crossing element at the same slot.

14 Claims, 8 Drawing Figures

CEILING SUSPENSION SYSTEM

BACKGROUND OF THE INVENTION

Frequently in buildings of modern construction, the ceiling is provided in the form of a grid or framework which is suspended from the slab of the floor above, or from rafters or joists of the building frame. Panels or tiles, e.g., of sound-absorbing material, are mounted in individual cells of the suspended grid. Lighting fixtures, heating, ventilating and air conditioning vents or grills and the like often are incorporated in such ceilings.

In commonly used ceiling suspension systems, the gridwork is assembled in place from largely pre-cut or pre-fabricated modules, with a certain amount of further cutting, bending, twisting and similar tailoring or modifying of elements being done by the assemblers on the site. It is not uncommon for suspended ceiling installers to work in pairs, on ladders or wheeled scaffolding, sometimes with an assistant for cutting some elements to length, opening cartons, inspecting and handing-up modules to be installed, and so forth.

Having had considerable experience with commercially available suspended ceiling systems, the present inventor has come to realize that the mechanical design of the elements of the systems now available embody shortcomings that render some installations considerably more difficult, time-consuming and expensive than fundamentally is necessary. In particular, the workers on ladders or scaffolding generally are called upon to perform manipulations by hand and with hand tools while working overhead, manipulations which are difficult and frustrating to perform in such an awkward orientation, and doubly so when something goes wrong and must be disassembled and redone. In fact, some popular ceiling systems are very mistake/change intolerant, so that if a later-noticed mistake made in the middle of a gridwork is to be remedied or a bent or defective element must be replaced or a change is mandated, much of the work that has already been done has to be taken down and redone. In fact, where bending, riveting, snapping together and similar comparatively irreversible manipulations are used for assembling the grid elements of such popular systems, it may be necessary to use a metal saw or cutters to sever the elements between joints, in the course of which much of what had been installed is destroyed and must be scrapped.

SUMMARY OF THE INVENTION

It is an object of the invention to provide a system of gridwork for a suspended ceiling, where the individual elements are comparatively easy to assemble while working overhead, and where if mistakes are to be corrected, defective elements to be replaced, or changes to be made, the remedial effort is comparatively easy to accomplish and few or no elements are necessarily destroyed in the course of making the changes.

A ceiling suspension grid system is provided in which cross tees are assembled to main beams by pushing tabs in the web of one through a corresponding slot in the webs of the other. The slots and webs are vertically oriented. Each slot is provided intermediate its height with at least one wide place of comparatively small vertical extent. The tabs are provided with correspondingly thickened bosses, but at slightly vertically displaced sites, so that two elements which are to be connected are oriented at slightly different levels so that the tab of one may be inserted through the slot of the other.

Then, upon these elements being brought to a common level, the tab cannot be withdrawn from the slot. By preference, the tabs of two longitudinally adjoining elements may be inserted in the same slot from opposite directions, and become disposed one over the other with the element ends being notched to accommodate the tabs of one another. Bracing fingers preferably are provided on these element ends to rigidify the assembled gridwork. The slots may be provided with two, vertically spaced wide spots, in order to facilitate disconnection of one of the elements from the crossing element without requiring disconnection of the respective longitudinally continuing element from the crossing element at the same slot.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
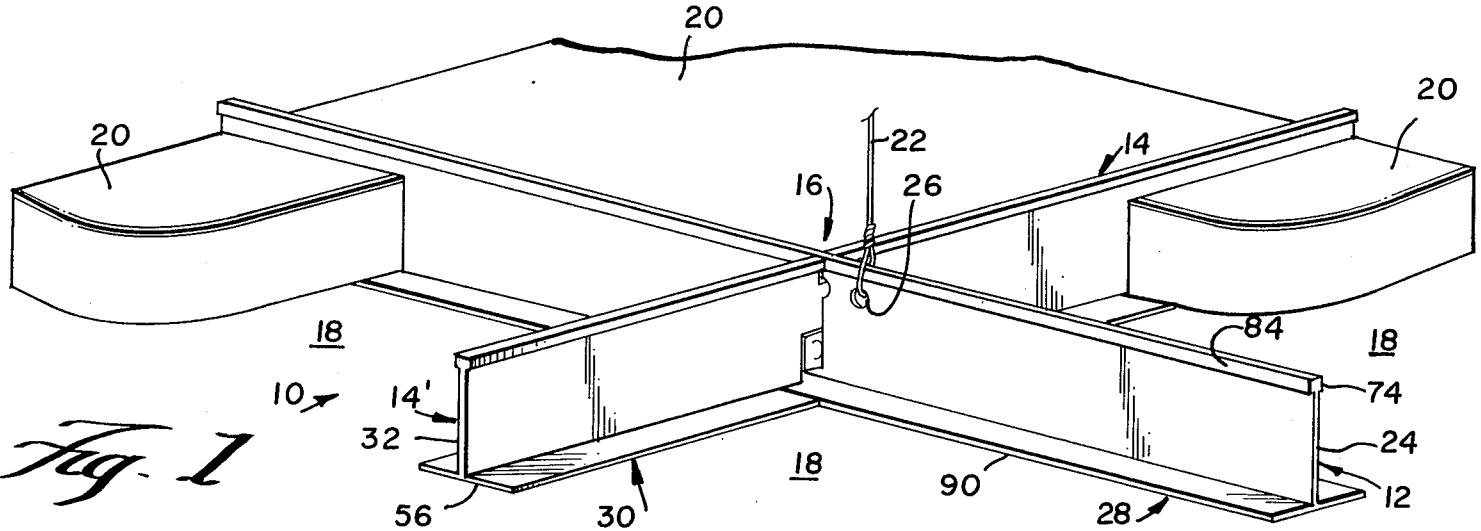
FIG. 1 is a fragmentary perspective view of a suspended ceiling incorporating a first embodiment of a ceiling suspension system in accordance with principles of the present invention.
Figure 2:
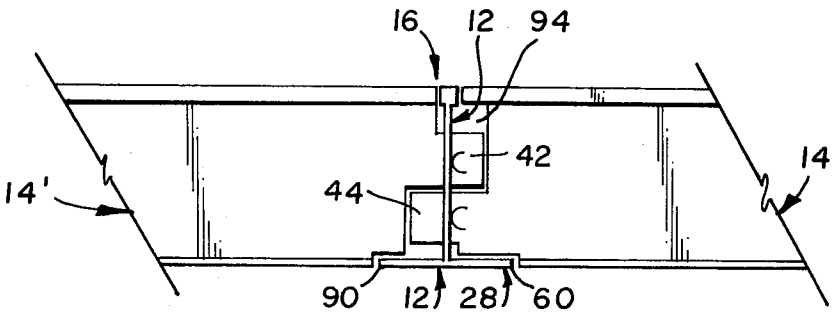
FIG. 2 is a fragmentary sectional view on line 2—2 of FIG. 1.
Figure 3:
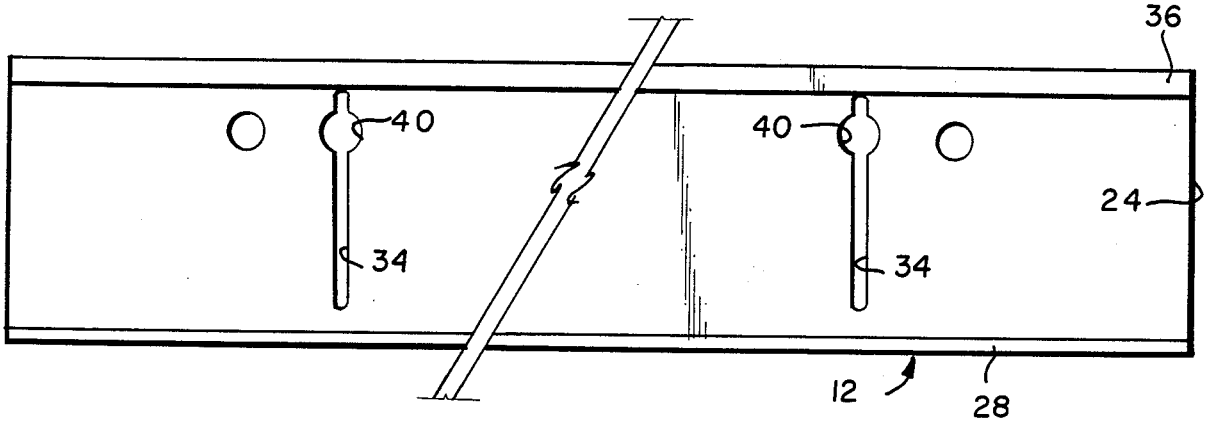
FIG. 3 is a fragmentary side elevation view showing the main beam of FIGS. 1 and 2.

In FIGS. 1 and 2, a representative intermediate portion of a suspended ceiling 10 is shown including a main beam 12 to which aligned ends of oppositely-extending cross tees 14, 14' are connected to provide a cross joint 16 which assists in defining among its four pairs of arms a respective number of rectangular grid cells 18 in each of which a conventional rectangular ceiling panel 20 may be supported.

In the instance depicted, the underside of an upper floor slab (not shown), or equivalent building structure, is provided with a number of depending hanger wires 22. The main beams 12, of which there would be several parallel ones laterally spaced from and at the same typically horizontal level as the one shown, have upright webs 24 provided every few feet with a respective opening 26 at an intermediate level. The lower ends of the wires 22 are inserted through the respective holes 26, doubled back upwards and twisted around upon themselves, e.g., as shown, in order to hangingly suspend the main beams from the superjacent pre-placed building structure. Other means could be provided for hangingly suspending the main beams 12, and, particularly for instances where spacing between main beams is unusually large, similar or identical means may be used for hangingly suspending the cross tees 14. However, the way that is shown, and which has just been described, seems to serve well and has been widely accepted, so is presently preferred.

Each of the main beams and cross tees is shown having a bottom flange 28, 30 which projects horizontally, i.e., at right angles, in both lateral directions, from the respective vertical web 24, 32. Where the flanges 28, 30 are made to be seen, the ceiling panels 20 may simply be deposited in the cells 18 from above and lowered so as to rest on the flanges 28, 30, as shown. In other instances, the ceiling panels may be rabbeted on their vertical edges to receive the flanges 28, 30, in which instances, the ceiling panels must be slid laterally into the cells 18 as soon as three sides of each cell are in place, after which the fourth side is installed. In such instances, the ceiling panel edges practically abut one another and the gridwork is practically invisible from below, with the possible exceptions of where the ceiling borders the walls, vents, lighting fixtures or the like.

The cross joint 16 is but one of several that would typically be provided at several sites spaced evenly along the length of the main beam, for instance, from every six inches, twelve inches, and so forth, up to every thirty-six inches or so. To that end, in manufacturing the main beams 12, at each site where a cross joint 16 is or may be desired, a vertically oriented slot 34 is provided through the thickness of the vertical web 24.

The main beams 12 and cross tees 14 preferably are made of aluminum extrusions of identical transverse cross sectional shape and size. Typically the main beams 12 are longer than the cross tees, e.g., twelve feet long and about half an inch longer than the intended lateral distance between centers of two neighboring main beams, e.g., about 6.5 inches, or about 12.5 inches, or up to about 36.5 inches, or so. (Actually, by preference, the dimensions of the system are calculated on a metric basis; and, later in this description, some more precise dimensions in centimeters will be given by way of example.) The main beams and/or cross tees could be fabricated by bending sheet metal and still provide most if not all of the desired advantages, but elements based on extrusions presently are preferred by the inventor. In the instance depicted, a longitudinal bead 36, 38 of thickened cross section integrally runs along the top of the webs 24, 32 for adding strength against sagging, bending and buckling to the respective structures.

The slots 34 in the main beam each start at or near the underside of the top bead 36 and extend down to near the bottom flange 28. Each slot 34 is straight and preferably is vertically oriented, i.e., is elongated in a sense that is normal to both the top bead and the bottom flange. In this embodiment, at one uniformly placed site along its height, e.g., nearer the upper end, each slot 34 is broadened as at 40. The vertical extent of each broadened spot 40 is comparatively small, compared with the overall height of the slot. And, at each such site, the respective slot 34 is broadened from being somewhat broader, e.g., about 1.5 times as broad as the thickness of the cross tee web 30, out to being substantially broader, e.g, about 2–3 times or so as broad as the cross tee web 30 is thick. The shape of each broadening site 40 is somewhat arbitrary. In the instance depicted, it is created by symmetrically superimposing a larger round hole 40 on the slot 34, but the enlargement could as well be rectangular, diamond-shaped, oval or be of some other figure. And although it is preferably regular and symmetrically placed, it could be irregular and/or unsymmetrically placed.

Figure 6:
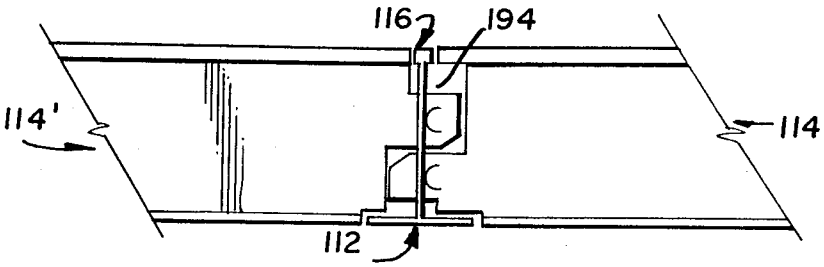
FIG. 6 is a fragmentary sectional view on line 6—6 of FIG. 5.
Figure 7:
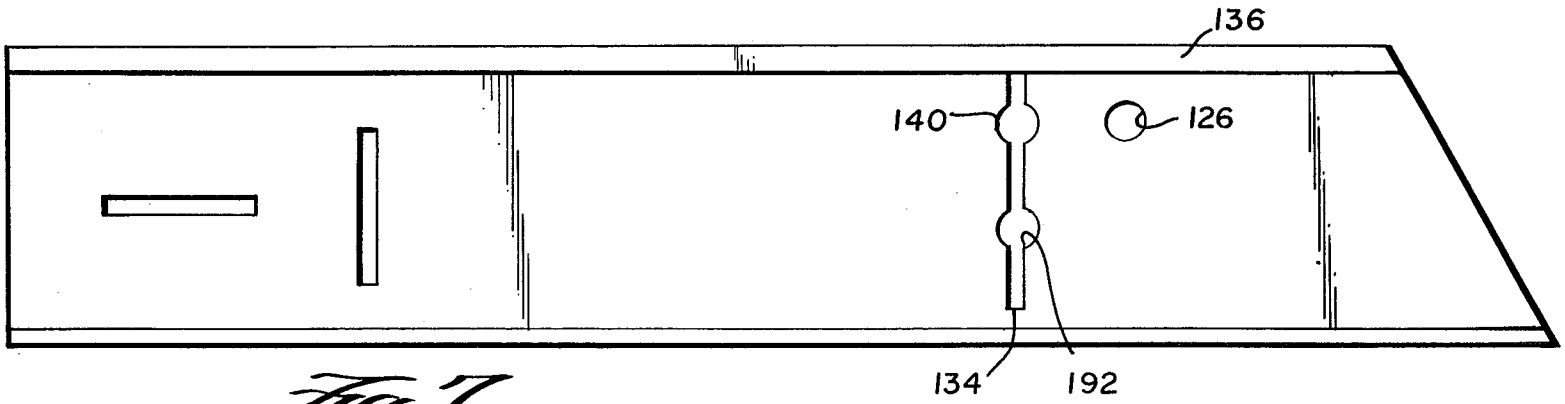
FIG. 7 is a fragmentary side elevation view showing the main beam of FIGS. 5 and 6.
Figure 8:
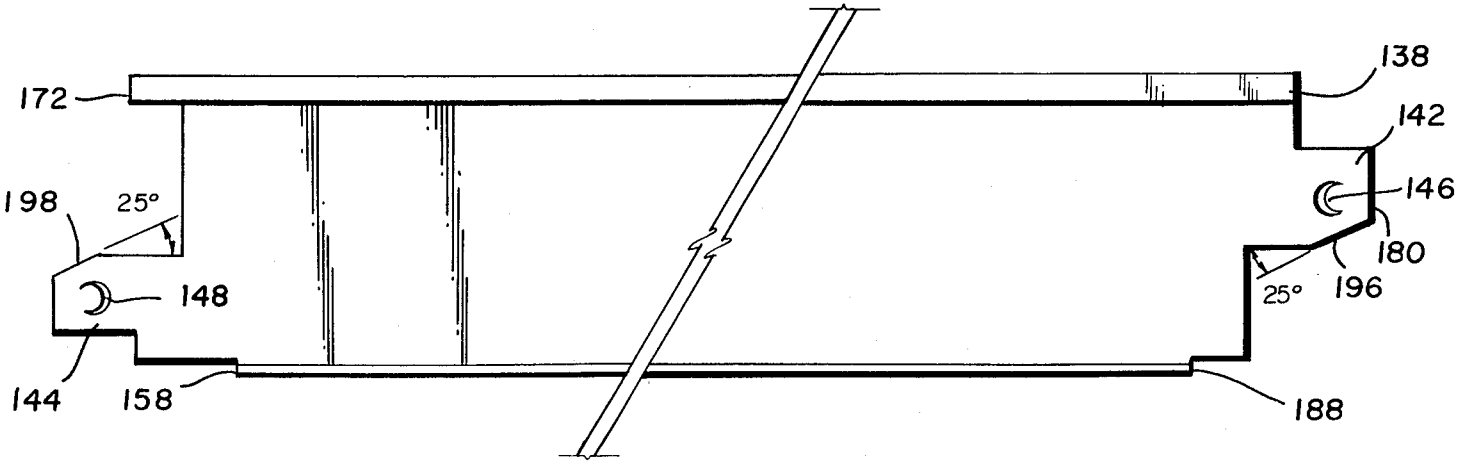
FIG. 8 is a fragmentary side elevation view showing a cross tee of FIGS. 5 and 6.

The shapes of the ends of the main beams 12 need not be important features of the present invention. Typically, they are square cut, and may be provided with slots for use in conventionally splicing on extensions of the main beam, end-to-end using conventional splicer plates as is further described hereinbelow in relation to the embodiment that is depicted in FIG. 6. Other conventional endings could be provided, and, in some instances, the main beams at either or both ends may be ended in the same manner as the cross tees are, in order to be connected and continued by means of connection to a slotted cross tee in much the same way as the cross tees are connected and continued by means of connection to a slotted main beam as shown and described herein.

Figure 4:
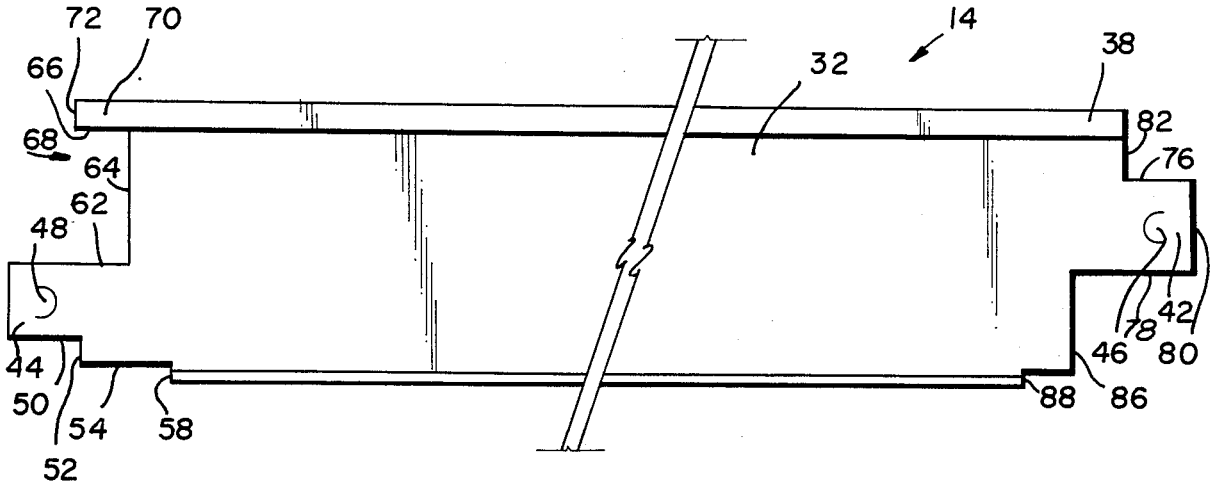
FIG. 4 is a fragmentary side elevation view showing a cross tee of FIGS. 1 and 2.
Figure 5:
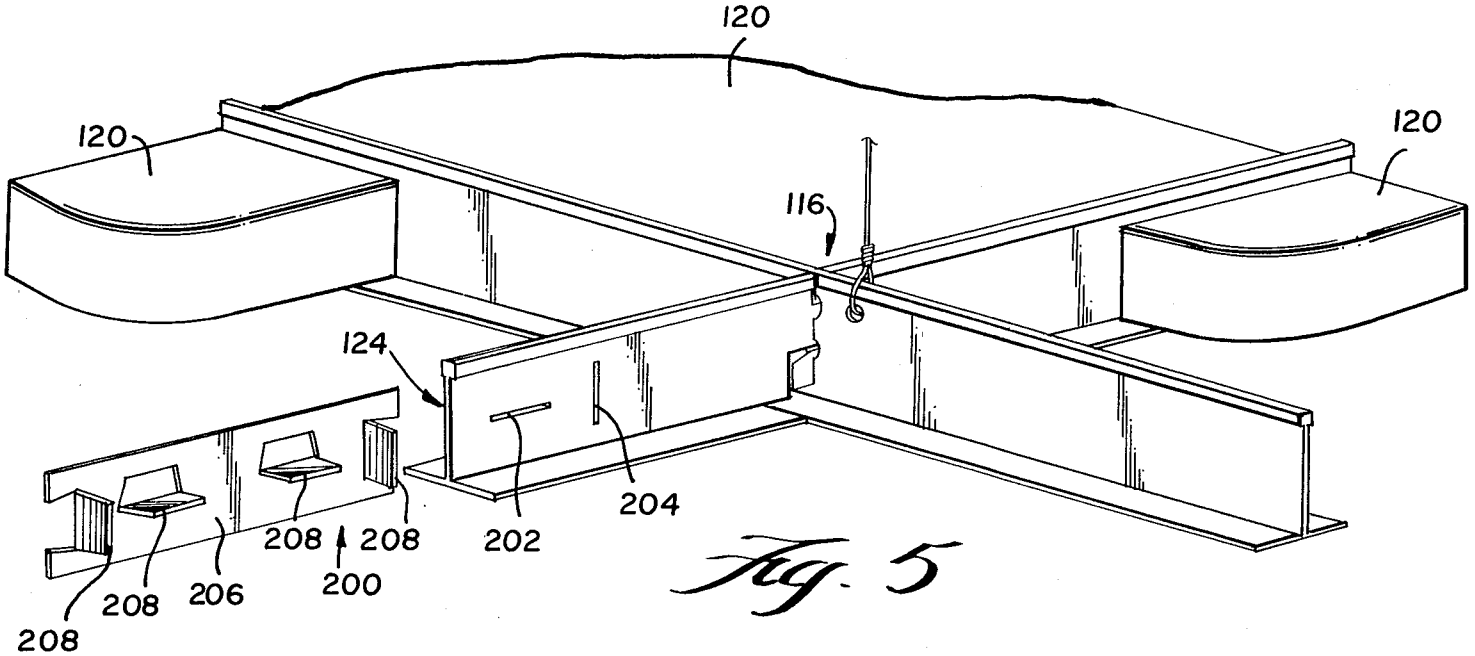
FIG. 5 is a fragmentary perspective view of a suspended ceiling incorporating a second embodiment of a suspension system in accordance with principles of the present invention.

With particular reference to FIG. 4, it should be noted that the two ends of the cross tee 14 are not identical or mirror image structures, but have some complementary structural features. In general, at an upper location spaced below the top bead 38, the right end of the cross tee 14 is notched above and below to provide an upper tab 42. Similarly, but at a lower location, above the bottom flange 30, the left end of the cross tee 14 is notched above and below to provide a lower tab 44.

Each of the tabs 42, 44 is shown provided at a central location with a protrusion 46, 48 which projects laterally in at least one direction so as to provide a respective localized site having a substantially greater thickness than the respective web 32, and to function, in effect, as a thickened boss. In the construction shown, the bosses 46, 48 are formed by only partially punching two circular holes in the web 32, so as to create respective ears which are severed from the web throughout about half of their circumferences and bent obliquely out of the plane of the web, e.g., as a consequence of the incomplete punching. The orientation of each ear is such as to present a ramp surface toward the slot 34 as the respective tab is being inserted through the slot at the level of the local enlargement 40, but to present an abrupt stop surface against the far side of the web 24 once the ear is through the enlargement 40 and the tab has been vertically displaced so that the ear cannot be pulled back through the slot.

Some preferred spatial relationships embodied in the shapes of the ends of the cross tee 14 of the first embodiment will now be described in connection with describing assembly of cross tees 14 to a main beam 12 at a cross joint 16.

A left end of a cross tee 14 is assembled to a main beam 12 at a cross joint 16 by raising the level of the respective cross tee 14 above the level of the main beam, with the lower tab 44 aligned with the slot 34, until the protrusion 48 is at the level of the broad spot 40 of the slot 34. While maintaining this alignment, the tab 44 is inserted through the slot until the protrusion 48 has emerged to the opposite side of the web through the broad spot 40 of the slot 34. Then the cross tee 14 left end may be lowered until the lower edge 50 of the tab 44 is at the bottom end of the slot 34, the lower notch vertical surface 52 lies adjacent the web 32, the lower notch downwardly facing surface 54 overlies and extends across the full width of the respective one arm 56 of the bottom flange 28, and the end surface 58 of the notched back bottom flange 30 abuttingly engages the vertical side edge 60 of the bottom flange 28. Above the lower tab 44 on the near side of the slot 34, surfaces 62, 64, 66 of the upper notch define a recess 68 for reception of an upper tab 42. The surface 62 faces upwardly, the surface 64 is vertical and faces the web 24 and the surface 66 faces downwardly. The surface 66 is shown provided on a cantilevered prong 70 constituted of a respective portion of the relatively thick, rigid top bead 38, this prong being sufficiently long and stiff that its free end surface 72 firmly engages the vertical side surface 74 of the top bead 36 of the main beam. At this time, the protrusion 48 also firmly engages the far side of the web 34, thus a triangulated, rigid brace is provided between the left end of the cross tee 14 and the main beam 12. Specifically, on the near side, the bottom flanges abut and the top beads abut, whereas on the far side, at an intermediate level, the radical protrusion edge 48 is pulled tightly against the main beam vertical web 24.

It should be noticed that until the cross tee bottom flange end surface 58 engages the side edge of the bottom flange and the prong end 72 engages the side of the main beam top bead 36, the cross tee 14 is capable of being tipped so that its left end is lower or higher than its right end, and the cross tee 14 may be reciprocated along its own longitudinal axis between an extreme of extension wherein the protrusion 48 engages the far side of the web 24 and an extreme of condensation wherein the vertical surface 64 of the upper notch engages the near side of the main beam top bead. This relative freedom to tilt and slide unless and until braced in place is very useful in the course of installing the cross tees 14, correcting mistakes, making changes, exchanging bent elements, and the like.

It should now be noticed that the distance provided vertically between the upwardly and downwardly facing surfaces 62 and 66 of the upper notch in the left end on the cross tee 14 is somewhat greater than the corresponding height dimension of the upper tab 42 on the right end of the cross tee 14'.

(Although both cross tees shown in FIGS. 1 and 2 are or may be substantially identical in structure, although not necessarily of equal length, should there be unequal lateral spacing between main beams, to avoid confusion in this description, the one having its left end shown in these Figures will be designated 14, whereas the one having its right end shown in these Figures will be designated 14'.)

Accordingly, with the left end of the cross tee 14 secured and braced to the main beam 12 as just described, the right end of the cross tee 14' may be secured and braced to the main beam 12 at the same slot 34 in order to complete the cross joint 16. To do so, the right end of the cross tee 14' is aligned with the slot, with the right end of the cross tee 14' positioned at a sufficiently higher level than the main beam 12 that the protrusion 46 on the upper tab 42 is aligned with the broad spot 40. While maintaining this alignment, the cross tee 14' is advanced along its own longitudinal axis towards the main beam, so that the upper tab 42 passes into and through the slot 34, with the protrusion 46 passing through the broad spot 40. It should be noted that the portion of the upper tab 42 of the cross tee 14' which passes through the slot 34 is received in the recess 68, with the upper surface 76 of the tab 42 sliding along just under the downwardly facing surface 66 and there being a gap vertically between the lower surface 78 of the tab 42 and the upwardly facing surface 62.

At the point that the protrusion 46 emerges through the broad spot 40, the vertical end surface 80 of the upper tab 42 lies adjacent the vertical surface 64, and the right end upper notch vertical surface 82 which extends vertically from the base of the upper tab 42 to the upper extent of the top bead 38 of the cross tee 14' engages the side 84 of the top bead 36 of the main beam. At this point, the vertical surface 86 of the right end lower notch lies adjacent and parallel to the vertical edge of the left end lower tab 44. The vertical surface 86 extends down from the base of the upper tab 42 to just above the level of the upper surface of the bottom flange 28 of the main beam 12. Below this, enough of the bottom flange 30 of the cross tee 14' is notched away, that when the cross tee 14' is slid down to match the level of the main beam 12 and cross tee 14, the vertical end edge surface 88 of the bottom flange 30 of the cross tee 14' abuts the vertical side edge 90 of the bottom flange 28 of the main beam. At this point, the end of the top bead 38 of the cross tee 14' engages the side of the top bead 36 of the main beam, and, on the opposite side of the main beam, the protrusion 46 on the upper tab 42 engages the web 24 of the main beam 12, likewise providing a three-point rigidly braced, secure connection of this cross tee to the main beam. In sliding the right end of the cross tee 14' downwards, the gap initially existing vertically between the upper and lower tabs has become extinguished, the lower surface of the upper tab now is juxtaposed upon the upper surface of the lower tab, and the gap has shifted to being between the upper tab 42 and the prong 70. Nothing needs to be bent, or irreversibly clicked together, or riveted or otherwise extraneously fastened in order to form the tight, secure, level joint at 16.

The right end of the cross tee 14' can be disconnected from the main beam 12 at the joint 16 by a reversal of the procedure just described. Then, the left end of the cross tee 14 can be disconnected from the main beam 12 at the joint 16.

The embodiment shown in FIGS. 4–8 has come to be the preferred embodiment, because its structure is modified to permit either cross tee to be connected to and disconnected from the main beam at the same joint without requiring connection or disconnection of the other as a prerequisite. Because the structure is so similar to that which has already been described, like numerals raised by 100 are used to designate equivalent features.

In particular, two changes have been made.

First, a second wide spot 192 is provided through the web 124 on the slot 134. It lies above the level of the protrusion 148 of the lower tab 144 by an amount equivalent to the height of the gap 194. Accordingly, the right end of the cross tee 114' may be connected to and disconnected from the main beam 112 at the joint 116 regardless of whether the left end of the cross tee 114 is previously or subsequently installed and connected at joint 116, and vice versa.

Second, the lower corner of the upper tab 142 has been trimmed off at an oblique angle at 196 and the upper corner of the lower tab 144 has been trimmed off at an oblique angle at 198 in order to facilitate independent tilting of the respective cross members 114 and 114' as they are being installed and disconnected, i.e., until they are pushed down into place and become securely braced in a level condition.

In using the exemplary splice shown at 200, the webs 124 which are each provided near their ends with a horizontal, intermediate level slot 202 and, spaced back from that, a vertical slot 204 are abutted end to end and plated on one face with a splicer plate 206 having four correspondingly placed cut and bent out tabs 208. The tabs 208 are pushed through the slots 202 and 204, then bent over flat against the far surface of the webs 124, thus uniting two sections of main beam 112 into a continuing length of main beam 112.

The terms "left" and "right" as used herein are meant to be illustrative, since the same principles would apply if the structures shown were turned end-for-end.

The following are given as non-limitative examples of dimensioning for the FIGS. 4–8 embodiment of the ceiling suspension system. The main beams and cross beams are made of lengths of extruded aluminum of like cross section. In the example, the bottom flange measures 25.40 mm across and is 1.27 mm thick; the vertical web is 28.27 mm high and also 1.27 mm thick; and the top bead is 2.92 mm high by 2.79 mm thick.

On the main beams, the slots 134 are 1.78 mm wide and terminate 4.45 mm above the underside of the bottom flange 128. The upper and lower wide spots in the slots 134 respectively measure 5.33 mm and 3.81 mm in diameter, the upper one being centered 8.25 mm down from the upper surface of the top bead 136 and the lower one being centered 11.43 mm below the center of the upper one. The hanger wire receiving holes 126 are centered at the same level as the slot upper wide spots and, in this example, are 4.70 mm in diameter.

On the cross tees, at the left end, the longitudinal distance from the end 158 of the bottom flange to the outer end of the lower tab 144 is 19.46 mm, and from the bottom flange end 158 to the prong end 172 is 11.29 mm. The lower tab 144 is 8.90 mm tall and begins 4.70 mm above the underside of the bottom flange. It is 13.43 mm long on the top and 8.30 mm long on the bottom, with the upper corner being clipped on a 25° angle. The protrusion 148 has a 1.63 mm radius, with its outer edge being located 6.03 mm behind the end of the lower tab 144.

At the right end of the cross tee, the protrusion 146 on the upper tab 142 is also cut on a 1.63 mm radius, with its outer edge also spaced 6.03 mm behind the vertical end surface 180 of the tab 142. The tab 142 is 10.67 mm tall, 8.17 mm long at the top and 13.43 mm long at the bottom. Its lower corner also is clipped at a 25° angle. The right end 188 of the bottom flange is spaced back 19.46 mm from the vertical outer end 180 of the tab 142. The upper surface of the tab 142 lies 7.97 mm below the upper surface of the top bead 138.

To reiterate, the above dimensions are exemplary and are not intended to be limiting.

It should now be apparent that the ceiling suspension system as described hereinabove possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A ceiling suspension system, comprising:

at least one main beam constructed and arranged to be suspended in an at least generally horizontal disposition from an overlying building structure such as a floor slab;

said main beam including a generally horizontal bottom flange, a web based on said bottom flange and extending upwardly therefrom, and a top bead provided as a thickening extending longitudinally along said web distally of said bottom flange;

means defining a generally narrow, vertically oriented slot through said web between said top bead and said bottom flange, said slot including at least one localized spot of substantially wider width disposed intermediate the vertical extent of the slot; and at least one cross tee constructed and arranged to disconnectably connect at an end thereof with said main beam proximally of said slot;

said cross tee including a generally horizontal bottom flange, a web based on said bottom flange and extending upwardly therefrom, and a top bead provided as a thickening extending longitudinally along said web of said cross tee distally of said bottom flange of said cross tee;

said cross tee at said end including a portion of said web projecting longitudinally of said cross tee to provide a tab having less vertical extent than said web of said cross tee, so that said cross tee end is, in effect, provided with an upper notch over said tab and a lower notch under said tab;

means providing an end surface on said top bead of said cross tee at said end of said cross tee, and means providing an end surface on said bottom flange of said cross tee at said end, said tab projecting longitudinally of said cross tee at said end beyond both said top bead end surface and said bottom flange end surface; and means defining a laterally projecting localized boss on said tab disposed longitudinally beyond both said top bead end surface and said bottom flange end surface and including a stop surface facing longitudinally oppositely to said end of said cross tee;

said boss being disposed relatively lower on said cross tee than a respective said wider spot of said slot of said main beam, and said top bead end surface, bottom flange end surface and boss stop surface being so constructed and arranged that as said tab is aligned with said slot, elevated to place the boss and said respective wider spot at a same level, projected through the slot until said boss stop surface has emerged through the web of the main beam, then lowered until the bottom flange of the main beam and the bottom flange of the cross tee are at a same level, said end surface of said bottom flange of said cross tee abuttingly engages the bottom flange of said main beam along a side edge of said bottom flange of said main beam, said end surface of said top bead of said cross tee abuttingly engages the top bead of said main beam along a side edge of said top bead of said main beam, and said stop surface of said boss abuttingly engages an opposite side surface of said web of said main beam beside said slot and below said respective wider spot, thereby securely bracing said cross tee against said main beam to provide a relatively rigid joint therebetween;

said bottom flange of said main beam and said bottom flange of said cross tee being constructed and arranged to cooperatively support a ceiling panel.

2. The ceiling suspension system of claim 1, wherein:

said main beam and said cross tee are of like transverse cross-sectional size and shape.

3. The ceiling suspension system of claim 2, wherein: said main beam and said cross tee are fabricated of respective integral lengths of extruded aluminum.

4. The ceiling suspension system of claim 3, wherein: said boss is constituted by a perimetrically incomplete punch-out of said web within said tab.

5. The ceiling suspension system of claim 3, wherein: said top beads are provided along the upper extents of the respective said webs.

6. The ceiling suspension system of claim 1, wherein: said cross tee is constructed and arranged to disconnectably connect at an opposite end thereof with said main beam exchangeably with disconnectable connection of said cross tee at said one end with said main beam, proximally of said slot;

said cross tee at said opposite end including a portion of said web projecting longitudinally of said cross tee to provide another tab having less vertical extent than said web of said cross tee, so that said cross tee opposite end is, in effect, provided with an upper notch over said other tab and a lower notch under said other tab;

means providing another end surface on said top bead of said cross tee at said opposite end of said cross tee, and means providing another end surface on said bottom flange of said cross tee at said opposite end, said tab projecting longitudinally of said cross tee at said opposite end beyond both said top bead other end surface and said bottom flange other end surface; and means defining a laterally projecting localized other boss on said other tab disposed longitudinally beyond both said other top bead and surface and said bottom flange other end surface and including a stop surface facing longitudinally oppositely to said opposite end of said cross tee;

said other boss being disposed relatively lower on said cross tee than a respective said wider spot of said slot of said main beam, and said top bead other end surface, bottom flange other end surface and other boss stop surface being so constructed and arranged that as said other tab is aligned with said slot, elevated to place the other boss and said respective wider spot at a same level, projected through the slot until said other boss stop surface has emerged through the web of the main beam, then lowered until the bottom flange of the main beam and the bottom flange of the cross tee are at a same level, said other end surface of said bottom flange of said cross tee abuttingly engages the bottom flange of said main beam along an opposite side edge of said bottom flange of said main beam from the first-described side edge thereof, said other end surface of said top bead of said cross tee abuttingly engages the top bead of said main beam along an opposite side edge of said top bead of said main beam from the first-described side edge thereof, and said other stop surface of said other boss abuttingly engages a side surface of said web of said main beam opposite to the first-described side surface thereof beside said slot and below said respective wider spot, thereby securely bracing said cross tee against said main beam to provide a relatively rigid joint therebetween.

7. The ceiling suspension system of claim 6, further including:

a second, like said main beam, whereby said cross tee may be disconnectably connected at said one end thereof to the first-described main beam and likewise disconnectably connected at said other end thereof to said second main beam so as to span between said main beams.

8. The ceiling suspension system of claim 6, further including:

a second, like said cross beam;

said tab at said one end of each said cross beam being disposed at so high a level thereon relative to said other tab at said opposite end of each said cross beam, and said upper notch over each said other tab and said lower notch under each first-described said tab that both of said cross tees may simultaneously become likewise disconnectably connected to said main beam at said slot, with said first-described tab of said first-described cross tee being disposed over said other tab of said second cross tee in said upper notch of said other end of said second cross tee while said other tab of said other cross tee is disposed under said first-described tab of said first-described cross tee in said lower notch of said first-described end of said first-described cross tee.

9. The ceiling suspension system of claim 8, wherein: each said tab is generally rectangular in side elevational profile, but each lower said tab has a chamfered upper outer corner and each upper said tab has a chamfered lower outer corner.

10. The ceiling suspension system of claim 9, wherein: said at least one localized spot of substantially wider width of said slot is constituted by two vertically spaced ones of said spots, one positioned to receive a respective first-described boss and the other positioned to receive a respective other boss.

11. The ceiling suspension system of claim 8, wherein: said at least one localized spot of substantially wider width of said slot is constituted by two vertically spaced ones of said spots, one positioned to receive a respective first-described boss and the other positioned to receive a respective other boss.

12. The ceiling suspension system of claim 8, wherein: said main beam and both said cross tees are of like cross-sectional size and shape.

13. The ceiling suspension system of claim 12, wherein:

said main beam and both said cross tees are fabricated of respective integral lengths of extruded aluminum.

14. The ceiling suspension system of claim 13, wherein:

each said boss is constituted by a perimetrically incomplete punch-out of the respective said web within the respective said tab.

* * * * *